US007690529B2

(12) United States Patent
Kim

(10) Patent No.: US 7,690,529 B2
(45) Date of Patent: Apr. 6, 2010

(54) AUTOMATIC MEDICINE PACKING MACHINE WITH DETACHABLE SHUTTER ASSEMBLY

(75) Inventor: Jun Ho Kim, Daegu (KR)

(73) Assignee: JVM Co., Ltd., Daegu (KR)

( * ) Notice: Subject to any disclaimer, the term of this patent is extended or adjusted under 35 U.S.C. 154(b) by 429 days.

(21) Appl. No.: 11/729,537

(22) Filed: Mar. 28, 2007

(65) Prior Publication Data

US 2008/0163588 A1 Jul. 10, 2008

(30) Foreign Application Priority Data

Jan. 5, 2007 (KR) ..... 10-2007-0001355

(51) Int. Cl.
*B65B 61/26* (2006.01)

(52) U.S. Cl. ..... 221/133; 221/263

(58) Field of Classification Search ..... 221/1, 221/92–94, 122, 130, 131, 133, 174, 186, 221/188, 189, 197, 200, 201, 204, 205, 208, 221/258, 263–266, 277

See application file for complete search history.

(56) References Cited

U.S. PATENT DOCUMENTS 4,421,185 A * 12/1983 Koto et al. ..... 177/25.18
5,348,061 A * 9/1994 Riley et al. ..... 141/104
5,787,678 A * 8/1998 Koike et al. ..... 53/154
6,079,592 A * 6/2000 Hennessy et al. ..... 221/206
6,216,418 B1 * 4/2001 Kim ..... 53/131.5
6,481,180 B1 * 11/2002 Takahashi et al. ..... 53/237
6,772,907 B2 * 8/2004 Kim ..... 221/131
7,428,805 B2 * 9/2008 Kim ..... 53/131.4
2005/0145644 A1 * 7/2005 Mori et al. ..... 221/242
2008/0029530 A1 * 2/2008 Yuyama et al. ..... 221/2

FOREIGN PATENT DOCUMENTS

EP 1489000 A1 * 12/2004
JP 08-20438 A 1/1996

* cited by examiner

*Primary Examiner*—Gene Crawford
*Assistant Examiner*—Kelvin L Randall, Jr.
(74) *Attorney, Agent, or Firm*—Seed IP Law Group PLLC

(57) ABSTRACT

The present invention relates to an automatic medicine packing machine for packing a variety of medicines dose by dose continuously. According to one embodiment, there is provided an automatic medicine packing machine for packing a variety of medicines dose by dose continuously, including: a plurality of cassette units in which the variety of medicines are accommodated; a hopper for collecting the medicines discharged from the cassette units; a packing unit for packing the medicines collected by the hopper; and a shutter assembly mounted on the hopper to temporarily suspend the medicines discharged from the cassette units, wherein the shutter assembly includes a frame detachably mounted to an upper end of the hopper; an openable/closable shutter unit arranged and mounted on the frame; a driving means for driving the shutter unit to be opened and closed; and an interlocking unit for transferring a driving force of the driving means to the shutter unit to interlock the shutter unit.

7 Claims, 5 Drawing Sheets

AUTOMATIC MEDICINE PACKING MACHINE WITH DETACHABLE SHUTTER ASSEMBLY

BACKGROUND OF THE INVENTION

1. Field of the Invention

The present invention relates to an automatic medicine packing machine capable of packing medicines automatically, and more particularly, to an automatic medicine packing machine with a shutter assembly, in which a shutter provided for improving the packing rate of medicines may be easily detached from a main body of the automatic medicine packing machine, whereby a user may easily perform a maintenance such as a cleaning process of the automatic medicine packing machine.

2. Description of the Related Art

Conventionally, an automatic medicine packing machine is supplied with medicines such as tablets, capsules and the like from a plurality of cassette units, in which the medicines classified by their kinds are respectively accommodated, and packs the medicines dose by dose continuously. The automatic medicine packing machine comprises a plurality of cassette units which are arranged in an upper portion of the main body of the automatic medicine packing machine and in which the medicines such as tablets, capsules and the like of which the sizes and shapes are different from each other are accommodated, a hopper disposed in a lower portion of the main body for collecting the medicines discharged and dropped from the cassette units, and a packing unit for packing the medicines collected by the hopper with a packing paper.

In order to improve the processing rate of such a conventional automatic medicine packing machine, it is required to increase a rate of discharging a predetermined number of medicines selected from the respective cassette units and a rate of packing the discharged medicines as soon as possible.

Japanese Patent Laid-open Publication No. H8-20438 discloses an automatic medicine packing machine having a shutter unit, which is disposed between cassette units arranged in an upper portion of a main body of the automatic medicine packing machine and a hopper arranged in a lower portion of the main body thereof and can temporarily suspend the discharged and dropped medicines, thereby improving the processing rate. Such a conventional shutter unit is configured to be selectively openable/closable by a driving unit such as a motor, and fixedly installed to an upper portion of the hopper.

According to the conventional automatic medicine packing machine as configured above, the shutter unit is provided between the cassette units in the upper portion of the main body and the hopper in the lower portion thereof, thereby causing the packing rate of the medicines to be improved.

Meanwhile, in the automatic medicine packing machine, several tens to several hundreds of medicines are accommodated in the respective cassette units, and the impact applied to the medicines when they are discharged and drop causes fine powders of the medicines to be generated, whereby the fine powders of medicine components different from each other are mixed and accumulated in the hopper or the discharge passage as well as the shutter unit.

Accordingly, since there can be a risk of accident caused by misuse of medicine, e.g., addition of any fine medicine component which is not required to a patient during the packing process of medicines, the user should clean the corresponding portions of the automatic medicine packing machine assuredly and periodically while confirming cleanliness of the respective portions thereof with his/her naked eyes.

However, since the shutter unit mounted to the conventional automatic medicine packing machine is fixed to the upper end of the hopper in order to be stably connected with the driving unit by which the shutter unit can be opened and/or closed as describe above, there is a problem in that it is impossible for a user to clean the shutter and the hopper while confirming the portions to be cleaned with his/her naked eyes.

As a result, there is a need for a shutter unit which can be mounted to the upper end of the hopper and easily detached for the periodic cleaning by the user to improve the packing rate of the medicines.

BRIEF SUMMARY OF THE INVENTION

Embodiments of the present invention provide an automatic medicine packing machine, in which a shutter assembly is mounted between cassette units of an upper portion of a main body of the automatic medicine packing machine and a hopper of a lower portion of the main body thereof, thereby improving the packing rate of medicines, and the shutter assembly is easily detached from the automatic medicine packing machine, so that a user may easily perform the maintenance such as cleaning of the automatic medicine packing machine.

According to one embodiment, an automatic medicine packing machine for packing a variety of medicines dose by dose continuously, comprises: a plurality of cassette units in which the variety of medicines are accommodated; a hopper for collecting the medicines discharged from the cassette units; a packing unit for packing the medicines collected by the hopper; and a shutter assembly mounted on the hopper to temporarily suspend the medicines discharged from the cassette units, wherein the shutter assembly includes a frame detachably mounted to an upper end of the hopper; an openable/closable shutter unit arranged and mounted on the frame; a driving means for driving the shutter unit to be opened and closed; and an interlocking unit for transferring a driving force of the driving means to the shutter unit to interlock the shutter unit.

According to one aspect, the frame is detachably installed to the upper end of the hopper by a fastening means with the shutter unit mounted to the frame and the shutter unit and the interlocking unit is detachably connected to each other.

In addition, preferably, the shutter unit is detachably mounted to the frame by a fastening means.

The shutter unit may include a shutter member pivotably mounted to open and close a passage between the cassette unit and the hopper, and a connection member detachably coupled to the interlocking unit and allowing the shutter member to be rotated by the driving force transferred through the interlocking unit.

Further, the interlocking unit may include an interlocking member installed to be pivotable on a pivot shaft by the driving means within a predetermined angle range, the pivot shaft is integrally formed in a lower end of the interlocking member, a fitting groove into which the connection member is detachably coupled is formed in an upper end of the interlocking member, and the connection member includes a cylindrical end portion to be detachably coupled to the fitting groove.

The interlocking unit may further include a rotational circular plate rotating together with a rotation shaft of the driving means, and a link member for connecting the rotational circular plate and the interlocking member to each other.

The interlocking unit may further include a plurality of interlocking members and a link member for connecting the interlocking members to each other.

Further, the shortest distance between inner peripheral surfaces of upper end portions of the fitting groove is preferably smaller than a diameter of the cylindrical end portion, whereby the cylindrical end portion is elastically coupled into the fitting groove.

According to another embodiment, an automatic medicine packing machine for packing a variety of medicines accommodated in a plurality of cassette units dose by dose continuously, comprises: a shutter assembly for temporarily suspending the medicines discharged from the cassette units, wherein the shutter assembly includes a shutter unit detachably mounted to the automatic medicine packing machine to open and close a passage through which the medicines are discharged from the cassette units; a driving means for driving the shutter unit to be opened and closed; and an interlocking unit for transferring the driving force of the driving means to the shutter unit to interlock the shutter unit.

According to yet another embodiment, an automatic medicine packing machine for packing a variety of medicines accommodated in a plurality of cassette units dose by dose continuously, comprises: a shutter assembly detachably mounted to the automatic medicine packing machine to temporarily suspend the medicines discharged from the cassette units, wherein the shutter assembly includes a shutter unit for opening and closing a passage through which the medicines are discharged from the cassette units; a driving means for driving the shutter unit to be opened and closed; and an interlocking unit for transferring a driving force of the driving means to the shutter unit to interlock the shutter unit.

BRIEF DESCRIPTION OF THE SEVERAL VIEWS OF THE DRAWINGS

The above and other objects, features and advantages of the present invention will become apparent from the following description of a preferred embodiment given in conjunction with the accompanying drawings, in which.

DETAILED DESCRIPTION OF THE INVENTION

Figure 1:
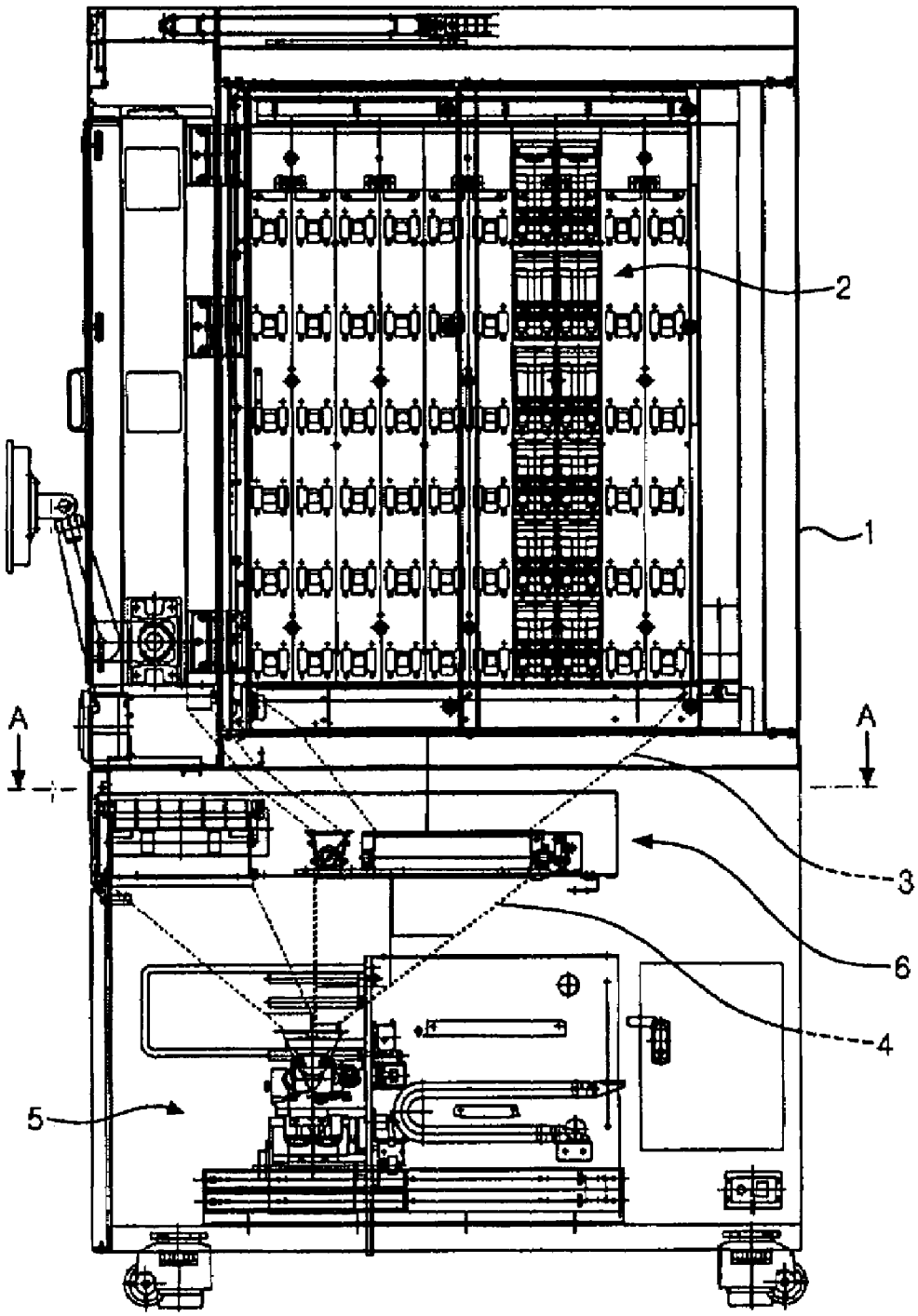
FIG. 1 is a side view showing an automatic medicine packing machine, to which a shutter assembly according to an embodiment of the present invention is mounted.
Figure 2:
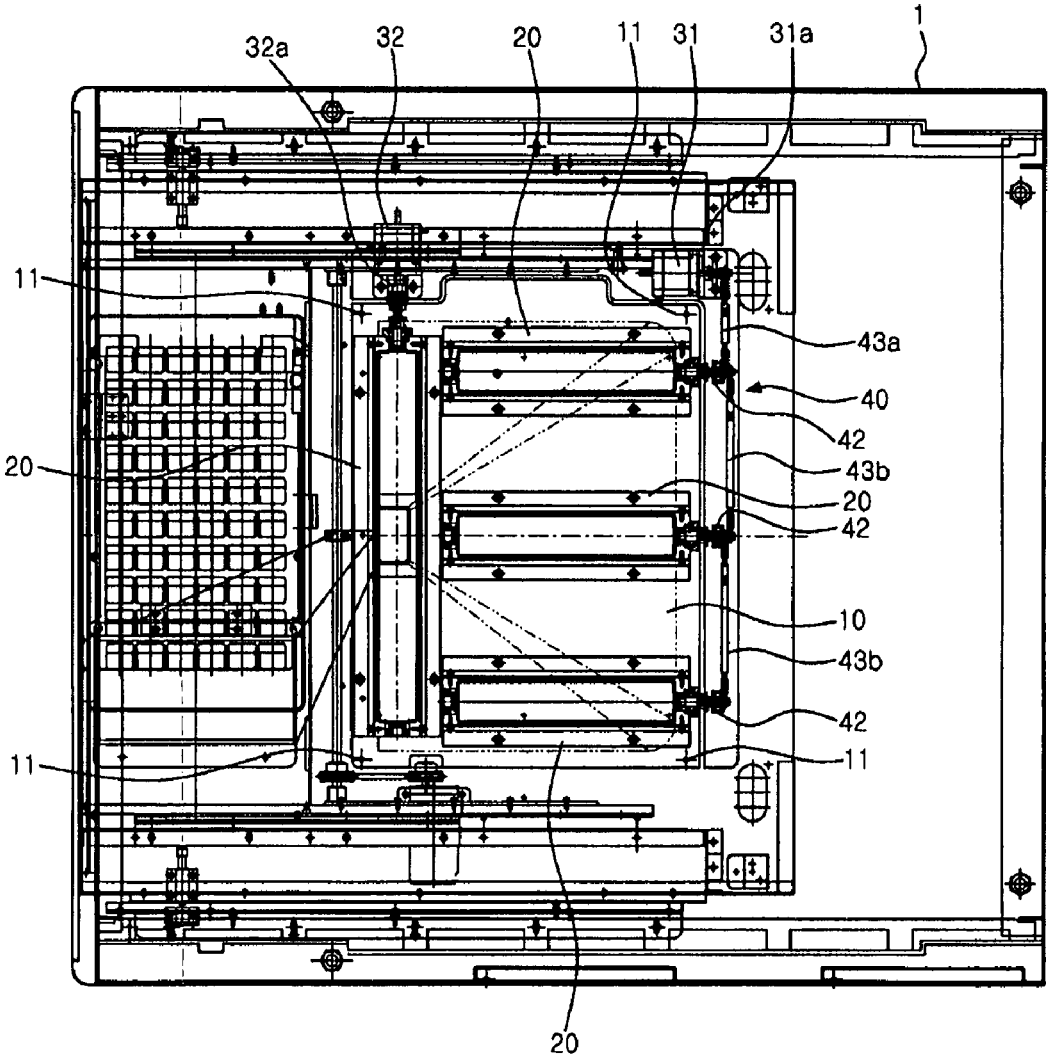
FIG. 2 is a sectional view taken along line A-A in FIG. 1.
Figure 3:
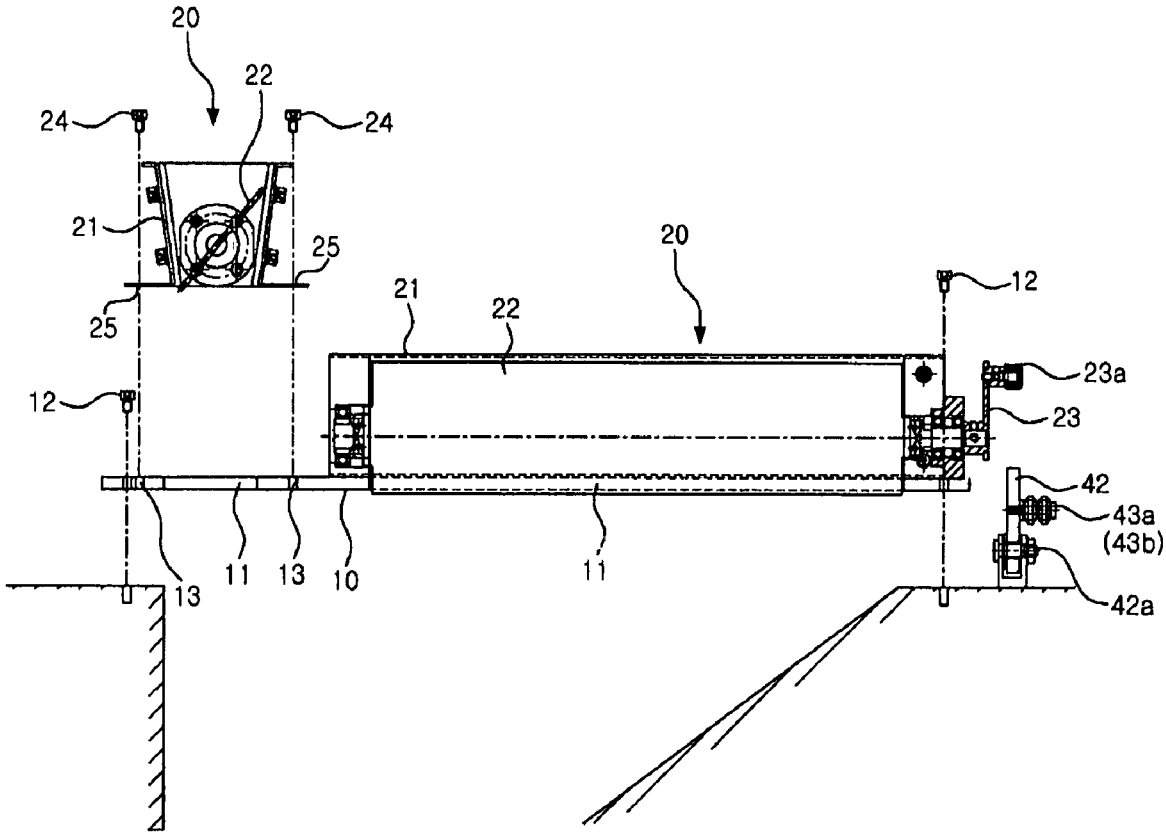
FIG. 3 is a partially sectional side view showing a detached state of a shutter assembly according to an embodiment of the present invention.

Hereinafter, an automatic medicine packing machine with a detachable shutter assembly according to embodiments of the present invention will be described in detail with reference to the accompanying drawings. FIG. 1 is a side view showing an automatic medicine packing machine, to which a shutter assembly according to one embodiment of the present invention is mounted, FIG. 2 is a sectional view taken along line A-A in FIG. 1, and FIG. 3 is a sectional side view showing a detached state of a shutter assembly according to an embodiment of the present invention.

The term "medicines" in the present invention is referred to as all pharmaceutical products which are solidified as tablets, capsules, pills and the like and formed in predetermined shapes.

As shown in FIG. 1, the automatic medicine packing machine for packing a variety of medicines dose by dose continuously includes a plurality of cassette units 2 which are arranged in an upper portion of a main body 1 and in which the medicines such as tablets, capsules and the like of which the sizes and shapes are different from each other are accommodated, first and second hoppers 3 and 4 arranged under the cassette units 2 for collecting the medicines discharged and dropped from the cassette units 2, and a packing unit 5 for packing the medicines collected by the first and the second hoppers 3 and 4 with a packing paper.

Herein, a shutter assembly 6 capable of temporarily suspending the medicines discharged and dropped from the cassette units 2 is installed between the first and the second hoppers 3 and 4. Since the passages through which the medicines are discharged, i.e., the first and the second hoppers 3 and 4 are bisected by the shutter assembly 6, the medicines can be discharged from the cassette units 2 into the first hopper 3 before the medicines on the way to be discharged in the second hopper 4 are supplied in the packing paper, whereby a packing operation of the medicines can be rapidly performed.

As shown in FIGS. 1 and 2, the shutter assembly 6 includes a frame 10 mounted to an upper end of the second hopper 4, one or more openable and closable shutter units 20, which are appropriately arranged and mounted on the frame 10 in correspondence to the arrangement of the cassette units 2 arranged in the upper portion of the main body, driving means 31 and 32 (for example, motors) for driving the shutter units 20, and an interlocking unit 40 for transferring a driving force of the driving means 31 and 32 to the shutter units 20 to interlock the shutter units 20.

The frame 10 has through holes 11 formed at positions for mounting the shutter units 20 according to the arrangement of the shutter units 20. Furthermore, as shown in FIG. 3, the frame 10 can be separated from the upper end of the second hopper 4, and can be fixed thereto by fastening means 12 such as bolts when the frame 10 is mounted.

FIG. 2 shows that all the four shutter units 20 are mounted to the frame 10, wherein three of the four shutter units 20 are installed widthwise in parallel with each other and one of the four shutter units 20 is installed toward first ends of the three shutter units 20 in a direction perpendicular thereto, but the present invention is not limited to such an arrangement.

As shown in FIG. 3, the fastening means 12 such as bolts or the like are inserted into and coupled with coupling holes 13 formed in the frame 10, so that the frame 10 may be fixedly mounted to the upper end of the second hopper 4. Meanwhile, the frame 10 can be simply detached from the upper end of the second hopper 4 by loosening the fastening means 12.

A pair of knobs (not shown) may be provided on the upper surface of the frame 10 for convenience of the attachment and detachment of the frame 10.

Furthermore, referring to FIGS. 2 and 3, each of the shutter units 20 includes a body 21 in the shape of a generally rectangular funnel with its upper and lower portions opened, a shutter member 22 pivotably mounted in the body 21 to open and close an opening of the body 21, and a connection member 23 which extends from one side of the shutter member 22 and is connected to the interlocking unit 40 in order to receive the driving force transferred through the interlocking unit 40.

FIG. 3 shows that the shutter member 22 is installed to be pivotable within a predetermined angle range in the body 21 thus to open and close the passage between the cassette units 2 and the second hopper 4, but the shutter member 22 may be configured so that it is horizontally positioned at the lower end of the body 21 close the opening of the body 21 and then is vertically rotated to open the opening.

In order to prevent the medicines from being damaged or broken when the medicines discharged and dropped from the cassette units 2 collide with the shutter member 22, an elastic material may be deposited on or attached to a surface of the shutter member 22.

The shutter unit 20 so configured can be detached from the frame 10 and fixed thereto by fastening means 24 such as bolts or the like when the shutter unit 20 is mounted.

As shown in FIG. 3, the fastening means 24 such as bolts and the like are inserted into and coupled with coupling holes 25 formed in the body 21 of the shutter unit 20, so that the shutter unit 20 can be fixedly mounted to the frame 10. Meanwhile, the shutter unit 20 can be simply detached from the frame 10 by loosening the fastening means 24.

Figure 5:
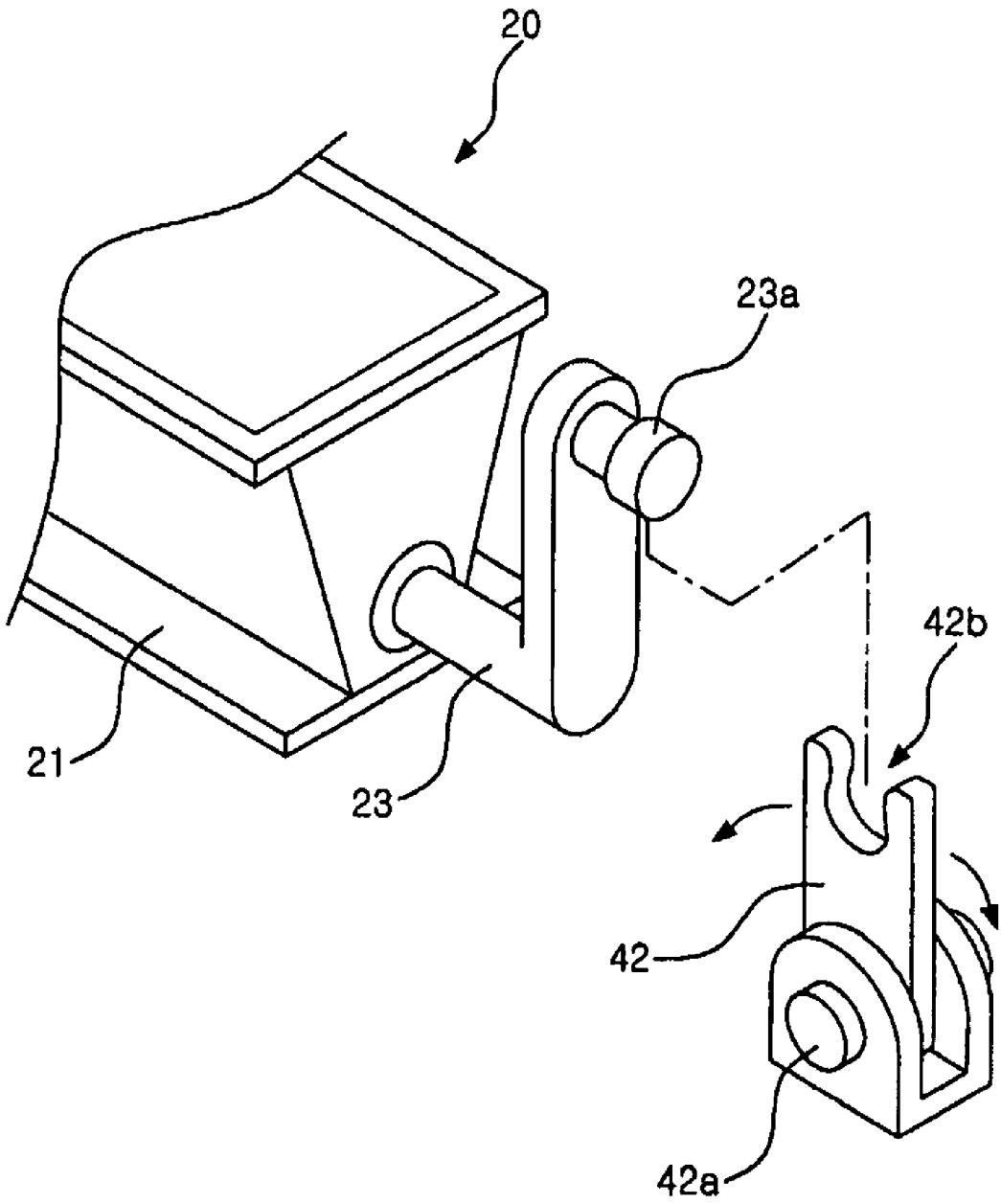
FIG. 5 is a partial perspective view illustrating a method of coupling an interlocking unit and a shutter assembly according to an embodiment of the present invention.

In order to detach the shutter unit 20 from the frame 10 as described above, the connection member 23 of the shutter unit 20 may be attached to and detached from the interlocking unit 40 as shown in FIG. 5. That is, an end portion 23*a* of the connection member 23 which extends from a rotation shaft of the shutter member 22 to be integrally formed therewith is formed in a shape of a cylinder, and is detachably coupled to the interlocking unit 40 as described below.

It is preferable that stepping motors capable of controlling a rotational angle in order to pivot the shutter member 22 at a predetermined angle be used as the driving means 31 and 32.

Referring to FIG. 2, first and second stepping motors 31 and 32 are used as the driving means. That is, the first stepping motor 31 for driving the three shutter units 20 arranged in parallel and the second stepping motor 32 for driving the shutter unit 20 arranged by itself toward the first ends of the three shutter units 20 are separately provided.

Such an arrangement is only one embodiment, and the present invention is not limited thereto. Furthermore, instead of using the single driving means for driving a plurality of shutter units 20, a single driving means corresponding to each of the shutter units 20 may be installed to drive each shutter unit 20 independently.

Figure 4:
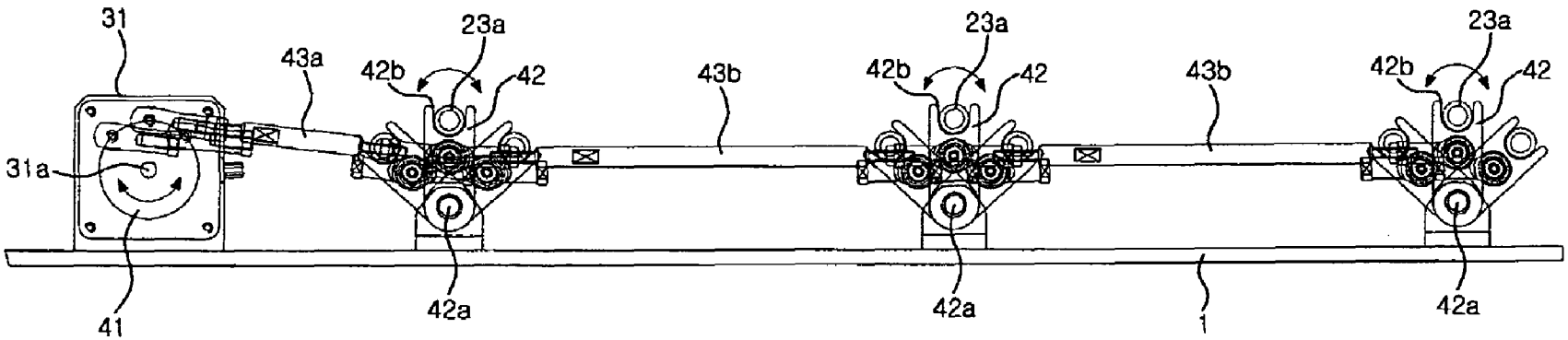
FIG. 4 is a view illustrating operation of an interlocking unit for driving a shutter of a shutter assembly according to an embodiment of the present invention.

The first stepping motor 31 is connected to the interlocking unit 40 which includes a series of link members 43*a* and 43*b* as shown in FIG. 4 in order for the first stepping motor 31 to drive a plurality of the shutter units 20 simultaneously.

As shown in FIG. 4, the interlocking unit 40 includes a rotational circular plate 41 rotating together with a rotation shaft 31*a* of the first stepping motor 31 as the driving means, an interlocking member 42 installed to be pivotable on a pivot shaft 42*a* within a predetermined angle range, and a link member 43*a* for connecting the rotational circular plate 41 and the interlocking member 42 to each other.

At this time, one or more interlocking members 42 may be installed, and FIG. 4 shows that all the three interlocking members 42 are installed. If two or more interlocking members 42 are installed as described above, it is preferable that link members 43*b* for connecting the respective interlocking members 42 to each other are added.

The pivot shaft 42*a* is integrally formed in a lower end of the interlocking member 42, and the link members 43*a* and 43*b* are pivotably connected to a central portion of the interlocking member 42. In addition, the connection member 23 of the shutter unit 20 is fitted into an upper end of the interlocking member 42. Particularly, the cylindrical end portion 23*a* of the connection member 23 is fitted into a fitting groove 42*b* concavely formed in the upper end of the interlocking member 42, as shown in FIG. 5, whereby the driving force can be transferred from the driving means 31 and 32 to the shutter unit 20 through the interlocking unit 40.

It is preferred that the interlocking member 42 be made of or coated with a material such as Teflon or the like having a superior wear resistance.

Furthermore, the shortest distance between inner peripheral surfaces of upper end portions of the fitting groove 42*b* is designed to be smaller than the diameter of the cylindrical end portion 23*a*. In addition, the cylindrical end portion 23*a* is caused to be elastically deformed when the cylindrical end portion 23*a* is inserted into the fitting groove 42*b*. Thus, a coupling state of the fitting groove 42*b* and the cylindrical end portion 23*a* can be securely maintained and the cylindrical end portion 23*a* can be prevented from escaping from the fitting groove 42*b* inadvertently.

Meanwhile, the second stepping motor 32 is connected to the interlocking member 42 which is installed to pivot on the pivot shaft 42*a* within a predetermined angle range as described above in order to drive only the single shutter unit 20. In particular, the rotation shaft 32*a* of the second stepping motor 32 is directly connected to the pivot shaft 42*a* of the interlocking member 42, so that the second stepping motor 32 and the interlocking member 42 are rotated at the same angle.

Further, since the descriptions on coupling of the interlocking member 42 and the shutter unit 20 is substantially identical to those related to the first stepping motor 31, they will not be further described in detail.

As described above, since the shutter unit 20 and the interlocking unit 40 can be simply connected to and separated from each other, the user can detach the respective shutter units 20 voluntarily from the frame 10 of the shutter assembly 6 if a work such as cleaning is required.

Furthermore, according to the embodiment as shown in FIGS. 2 and 3, the driving means 31 and 32 and the interlocking unit 40 are mounted to an outside of the frame 10. The user can detach only the shutter units 20 from the frame 10, if necessary. The user can also detach the frame 10 to which the shutter units 20 mount as a whole from the main body 1 of the automatic medicine packing machine.

Alternatively, it is possible to install the driving means 31 and 32 and the interlocking unit 40 together with the shutter unit 20 to the frame 10. Further, the frame 10 is fixed to the main body 1 of the automatic medicine packing machine, and each shutter unit 20 can be configured only to be detached from the frame 10. Furthermore, it is preferable that the shutter assembly 6 and the second hopper 4 are configured to be drawn as a whole from the main body of the automatic medicine packing machine in a drawer manner because such a configuration makes it possible to clean the automatic medicine packing machine and to detach the shutter units 20 easily.

According to embodiments of the present invention as described above, there is provided an automatic medicine packing machine, in which a shutter assembly is mounted between a cassette unit of an upper portion of a main body of the automatic medicine packing machine and a hopper of a lower portion of the main body in order to improve the packing rate of the medicines. At the same time, the shutter assembly is configured to be easily detached from the automatic medicine packing machine, whereby a user can easily perform the maintenance such as cleaning.

The automatic medicine packing machine with the shutter assembly according to an embodiment of the present invention has been illustrated as described above with reference to the accompanying drawings, but the present invention is not limited to the embodiment as described above and the accompanying drawings. It will be apparent to those skilled in the art that various modifications and changes can be made thereto within the spirit and scope of the present invention. Therefore, it is obvious that the true scope of the present invention should be defined by the appended claims.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. An automatic medicine packing machine for packing a variety of medicines dose by dose continuously, comprising:

a plurality of cassette units in which the variety of medicines are accommodated;

a hopper configured to collect the medicines discharged from the cassette units;

a packing unit configured to pack the medicines collected by the hopper; and a shutter assembly mounted on the hopper to temporarily suspend the medicines discharged from the cassette units, the shutter assembly including a frame detachably mounted to an upper end of the hopper, an openable and closable shutter unit arranged and mounted on the frame, a driving device configured to drive the shutter unit to be opened and closed, and an interlocking unit configured to transfer a driving force of the driving device to the shutter unit to interlock the shutter unit, the shutter unit including a shutter member pivotably mounted to open and close a passage between the cassette unit and the hopper, and a connection member detachably coupled to the interlocking unit and allowing the shutter member to be rotated by the driving force transferred through the interlocking unit, the interlocking unit including an interlocking member installed to be pivotable on a pivot shaft by the driving device within a predetermined angle range, the pivot shaft being integrally formed in a lower end of the interlocking member, a fitting groove into which the connection member is detachably coupled being formed in an upper end of the interlocking member, and the connection member including a cylindrical end portion to be detachably coupled to the fitting groove.

2. The automatic medicine packing machine as claimed in claim 1 wherein the frame is detachably installed to the upper end of the hopper by a fastening device with the shutter unit mounted to the frame, and the shutter unit and the interlocking unit are detachably connected to each other.

3. The automatic medicine packing machine as claimed in claim 2 wherein the shutter unit is detachably mounted to the frame by a fastening device.

4. The automatic medicine packing machine as claimed in claim 1 wherein the interlocking unit further includes a rotational circular plate rotating together with a rotation shaft of the driving means, and a link member for connecting the rotational circular plate and the interlocking member to each other.

5. The automatic medicine packing machine as claimed in claim 4 wherein the interlocking unit further includes a plurality of interlocking members and a link member for connecting the interlocking members to each other.

6. The automatic medicine packing machine as claimed in claim 1 wherein the shortest distance between inner peripheral surfaces of upper end portions of the fitting groove is smaller than a diameter of the cylindrical end portion, whereby the cylindrical end portion is elastically coupled into the fitting groove.

7. A shutter assembly configured to temporarily suspend medicines discharged from a cassette unit of an automatic medicine packing machine having a hopper unit, the shutter assembly comprising:

a shutter unit configured to be coupled to the automatic medicine packing machine to open and close a passage through which the medicines are discharged from the cassette unit, the shutter unit including a connection member and a shutter member pivotably mounted to open and close a passage between the cassette unit and the hopper unit;

a driving device configured to drive the shutter unit to be opened and closed; and an interlocking unit configured to transfer a driving force of the driving device to the shutter unit to interlock the shutter unit, the interlocking unit including an interlocking member, a pivot shaft pivotably mounting the interlocking member to pivot in response to the driving force within a predetermined angle range, and a fitting groove, the connection member of the shutter unit including a cylindrical end portion detachably coupled to the fitting groove and allowing the shutter member to be rotated by the driving force transferred through the interlocking unit.

* * * * *